United States Patent [19]

Mar

[11] 4,169,312

[45] Oct. 2, 1979

[54] KNIFE WITH INTERCHANGEABLE BLADES

[76] Inventor: Alfred C. Mar, 5861 SW. Benfield Ct., Lake Oswego, Oreg. 97034

[21] Appl. No.: 937,187

[22] Filed: Aug. 28, 1978

[51] Int. Cl.[2] ..... B26B 1/00

[52] U.S. Cl. ..... 30/337; 30/331

[58] Field of Search ..... 30/337, 330, 331, 335, 30/342

[56] References Cited

U.S. PATENT DOCUMENTS

| | | | |
|---|---|---|---|
| 842,173 | 1/1907 | Carman | 30/337 |
| 1,018,210 | 2/1912 | Segel et al. | 30/337 |
| 2,018,603 | 10/1935 | Case et al. | 30/337 |
| 2,439,071 | 4/1948 | Basham | 30/337 |

FOREIGN PATENT DOCUMENTS

| | | | |
|---|---|---|---|
| 307411 | 8/1918 | Fed. Rep. of Germany | 30/337 |

*Primary Examiner*—Robert Louis Spruill
*Assistant Examiner*—J. T. Zatarga
*Attorney, Agent, or Firm*—Kolisch, Hartwell, Dickinson & Stuart

[57] ABSTRACT

A knife accommodating interchangeable blades. The knife includes a blade having a tang extending from its base, and an elongate handle having a front, blade-receiving region and an opposed back region. An elongate lever having opposed pivot and locking points is attached at its pivot point in the back region of the handle for swinging toward and away from a locked position in which the lever is axially aligned with the handle. The lever provides, adjacent its pivot point, a cammed surface dimensioned to engage a spring arm within the handle, thus to lock the lever in its locked position. The blade tang is securely held within a cavity defined in part by the locking point of the lever, with the latter in locked position.

4 Claims, 6 Drawing Figures

KNIFE WITH INTERCHANGEABLE BLADES

BACKGROUND AND SUMMARY

The present invention relates to knives, and in particular, a knife for accommodating interchangeable blades.

It is an object of the present invention is to provide a knife having a handle and a variety of blades adapted to be detachably and interchangeably held thereby.

Another object of the present invention to provide in an interchangeable-blade knife of this type, a self-locking lever for locking a selected blade to the handle.

Yet another object of the present invention is to provide, in an interchangeable-blade knife, a blade-locking mechanism which affords mechanical advantage in the operation thereof.

The present invention includes a blade having a tang extending from its base, and an elongate handle having a front, blade-receiving region and an opposed back region. The handle includes a tension fork having an axially-extending base adjacent the blade-receiving region of the handle and outer and inner arms attached to the base and extending axially therefrom. The outer arm forms at least a portion of the handle back region, and the inner arm defines, distally, a contact surface.

An elongate lever having opposed pivot and locking points is mounted at its pivot point in the back region of the handle for swinging movement toward and away from a locked position in which the lever is substantially axially aligned with the handle. The lever defines, adjacent its pivot point, a cammed surface dimensioned to engage, slideably and forceably, the inner arm contact surface as the lever is swung toward its locked position, whereupon the inner arm is forced toward the outer arm, to lock the lever in locked position.

A cavity for receiving the blade tang securely therein is defined along one edge by the base of the tension fork, and by the locking point of the lever, with the latter in locked position.

Other objects and features of the present invention will become more fully apparent with reference to the following detailed description of the invention and the accompanying drawings.

DRAWINGS

DETAILED DESCRIPTION OF A PREFERRED EMBODIMENT OF THE INVENTION

Figure 1:
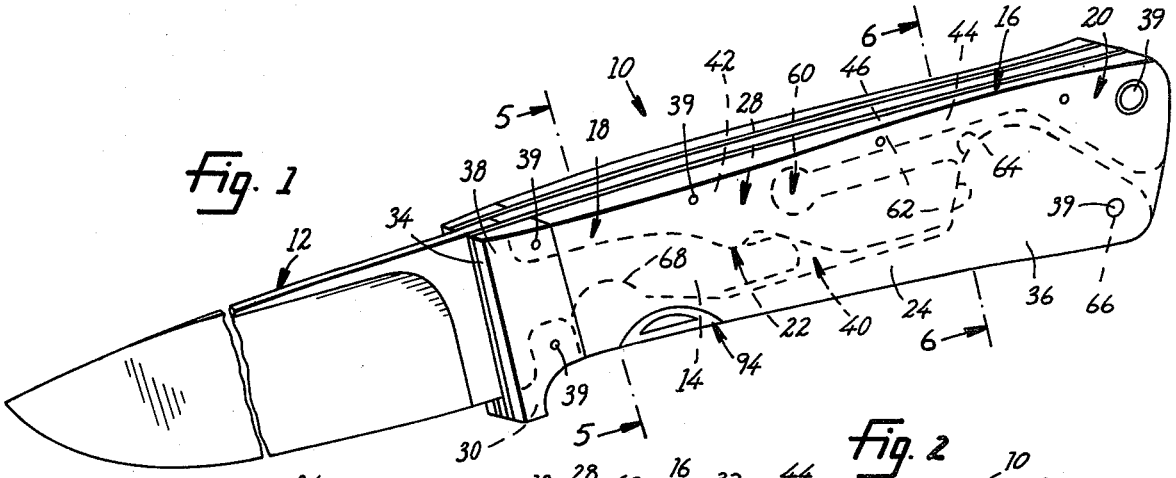
FIG. 1 is a perspective view of a knife constructed according to a preferred embodiment of the invention.
Figure 2:
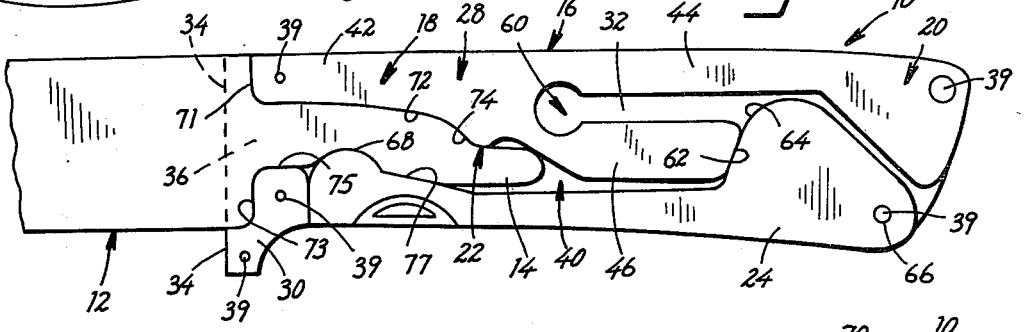
FIG. 2 is a fragmentary side view of the knife, with parts of the handle removed.
Figure 3:
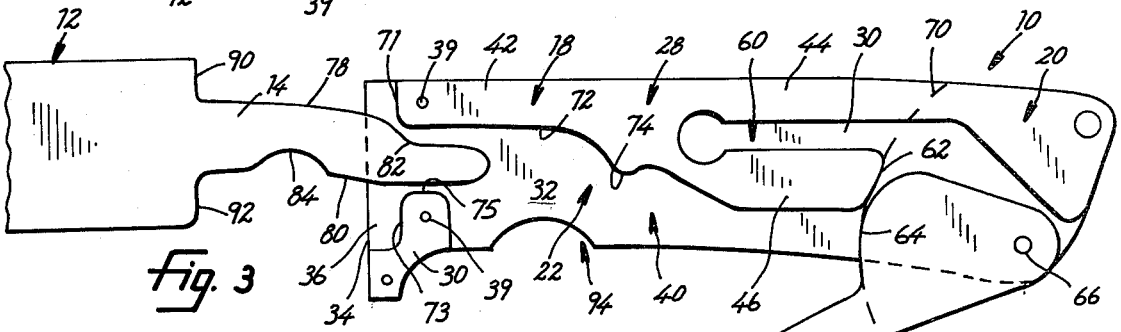
FIG. 3 is a view similar to FIG. 2, shown with the lever arm moved toward its open position and the blade partially removed from the handle.

Referring now to the drawings, and in particular to FIGS. 1-3, there is shown at 10 a knife constructed according to a preferred embodiment of the invention. The knife includes one of a variety of interchangeable blades, such as blade 12 having a tang 14 extending from the base thereof, and a knife handle 16 having a front, blade-receiving region, indicated at 18 and an opposed back region, indicated generally at 20. The blade tang is detachably held within a cavity 22 which is contained wholly within the front region of the handle, and defined in part by an elongate lever 24, with such in a locked position, as shown in FIGS. 1 and 2.

Figure 6:
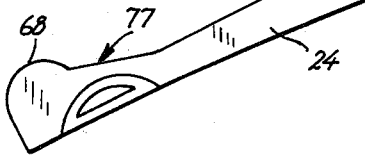
FIG. 6 is a sectional view taken along the line 6—6 in FIG. 1.
Figure 6:
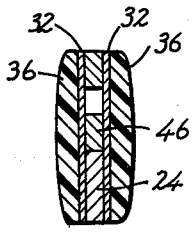
Figure 5:
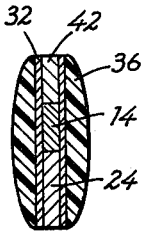
FIG. 5 is a sectional view taken along the line 5—5 in FIG. 1.

Handle 16 includes a tension fork 28 and a spacer 30 which are held in fixed relation one with the other by a pair of opposed side plates 32 attached to opposite sides of the fork and spacer (FIG. 6). Side plates 32, which define the general shape of the knife handle, extend from the back region of the knife forwardly to a front edge 34. A pair of opposed handle plates 36 and front guards 38 are attached to the outwardly facing sides of plates 32. The handle components just described are fastened together conventionally by rivets, such as rivets 39 extending transversely through the handle.

Figure 4:
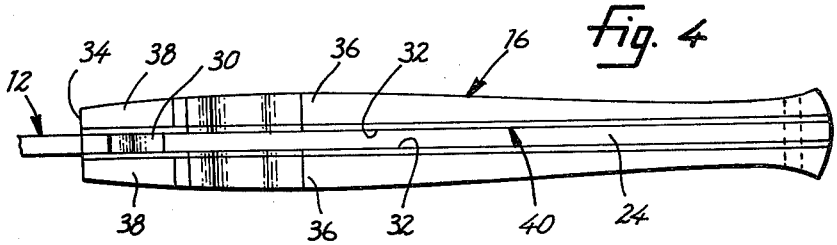
FIG. 4 is a bottom plan view of the knife of FIG. 1.

With reference to FIG. 4, it can be appreciated that tension fork 28 and spacer 30, which have equal thicknesses, serve to space apart side plates 32, forming a slot 40 therebetween. As best seen in FIG. 2, slot 40 is dimensioned to receive therein tang 14 and lever 24, with the latter in a locked position, as will be described.

Referring to FIGS. 2 and 3, tension arm 28 may be thought of as having an axially-extending base 42, and outer and inner arms 44, 46 respectively, attached to base 42 and extending substantially axially therefrom. The two arms are spaced apart by a keyhole-shaped cavity 60. Outer arm 44 extends from base 28 to the back end of the handle, forming a portion of the handle back region. Inner arm 46 defines, at its distal end, a contact surface 62 for a purpose to be explained. Tension fork 28 is formed of a single piece of spring tension metal, such as steel, permitting arm 46 to be moved tensionably toward arm 44.

Viewing FIGS. 1-3, lever 24 is an elongate member having a pivot point, or opening 66 and an opposed locking point, or protuberance 68. The lever is pivotally mounted on the handle by a rivet 39 extending through opening 66 and pairs of plates 32, 36 at the back region of the handle. The lever may be swung toward and away from a locked position, shown in FIGS. 1, 2, wherein the lever is substantially axially aligned with the handle.

Lever 24 defines, adjacent point 66, a cammed surface 64 dimensioned to engage, slideably and forceably, contact surface 62, as the lever is moved toward its locked position. As can be appreciated from FIG. 3, the mutually engaging portions of the contact and cammed surfaces 62, 64, respectively, are coincident with an arc, indicated at 70, generated about the center of opening 66. Above such mutually engaging portions, surface 64 has a smaller radius of curvature on progressing upwardly as viewed in the figures. Thus, as the lever is moved from an open position, seen in FIG. 3, toward its closed position, surface 64 contacts a progressively greater portion of the radially-coincident surface 62, forcing arm 46 toward arm 44.

In the embodiment shown herein, the distance between locking point 68 and pivot point 66 is approximately three times the distance between cammed surface 64 and point 66. Thus, surface 64 acts against surface 62 with a force approximately three times the force applied to the free end of the lever, when the lever is manually advanced toward its closed position. The mutually opposing forces between surfaces 62, 64 thereby established serve to hold the lever arm securely in locked position. Lever locking means, releasably locking the lever to the handle thus includes a lever having a cammed surface and means contained within the handle and providing a contact surface for engaging such cammed surface.

Referring to FIGS. 2 and 3, the upper edge portion of cavity 22 is defined by the front edge 71 of fork base 42 and the lower edge portion 72 thereof which terminates at a protuberance 74. The lower edge portion of the cavity is defined in part by orthogonal edges 73, 75 of spacer 30, and by the inwardly facing edge 77 of lever 24 adjacent and including protuberance 68. The sides of cavity 22 are formed by opposed inner walls of side plates 32.

The upper and lower edges 78, 80, respectively, of tang 14 are complementary in shape to the upper and lower edge portions of cavity 22, and have defined therein upper and lower recesses 82, 84, respectively. With blade 12 fully inserted into handle 16 such that the edges 90, 92 of the base of the blade abut edges 71, 73 of the tension fork and the spacer, respectively, protuberance 74 is received within recess 82, and protuberance 68, within recess 84, when the lever is swung to its locked position. Functionally, when protuberance 68 engages recess 84 upon swinging of lever 24 to its locked position, the tang is forced rearwardly, carrying protuberance 74 into recess 82 and surfaces 71, 73 against blade surfaces 90, 92, respectively. The blade is thus immobilized axially and hence, angularly within the handle. Recess 84 and protuberance 68 thus form blade-locking means for locking the lever to the tang, with the latter being positioned within cavity 22, and the former being in its locked position.

To attach blade 12 to the above-described handle, lever 24 is swung away to an open position, shown in FIG. 3, allowing tang 14 of the blade to be inserted into the handle's blade-receiving region. Opposed side plates 32 and handle plates 36 are notched at 94 to permit access to the lever in its locked position. Lever 24 is then moved toward locked position by applying a torque to the lock end of lever 24, in the direction tending to engage cammed surface 64 with locking surface 62. As these two surfaces engage, arm 46 is forced, under spring tension, in the direction of arm 44. The displacement of arm 46, which occurs as the lever is moved toward the handle, creates mutually opposing forces acting between surfaces 62, 64 thus to maintain lever 24 secured in its locked position. In such position, the tang is tightly engaged along both its top and bottom edges, with protuberances 74, 68 received in recesses 82, 84, respectively, serving to anchor the blade within the cavity, as described above. In this configuration, the tang is wholly confined within the cavity formed by the handle and the lever arm.

The above-described features of the present invention result in several advantageous features. First, the blade is held tightly and securely within the handle by virtue of the particular complementary features of the tang and the cavity. These include, generally, protuberance and notch means, as described above, for maintaining the axial position of the tang within the cavity.

Second, by virtue of the construction of the lever and the manner of its locking to the handle, a severalfold mechanical advantage is gained when the lever locking means, comprising contacting surfaces 64, 62, is engaged. This allows the lever arm to be placed in locked position under considerable tension.

Third, the blade is detachably secured to the handle by a single lever movement. This is in contrast to prior art devices in which a locking lever, once moved to a locked position, is maintained thereat by engagement of a lever latch.

A knife accommodating interchangeable blades, wherein the blade is held firmly within the knife handle by a lever which is locked at its back end by novel lever locking means, and secures the blade at its forward end by protuberance and recess means, has been disclosed. Various modifications and changes may be made without departing from the spirit of this invention.

It is claimed and desired to secure by letters patent:

1. A knife accommodating interchangeable blades comprising a blade having a tang extending from the base thereof, an elongate handle having a front region and an opposed back region, said handle including a tension fork having an axially-extending base forming at least a portion of said front region, and outer and inner arms attached to said base and extending substantially axially therefrom, said outer arm forming at least a portion of said back region, an elongate lever having opposed pivot and locking points, mounted at its pivot point in the back region of the handle for swinging movement toward and away from locked position in which the lever is substantially axially aligned with said handle, lever locking means including a contact surface defined on said inner arm and a cammed surface defined on said lever adjacent its pivot point, the latter surface being dimensioned to engage slideably and forceably said contact surface, and force said inner arm toward said outer arm, as said lever is swung toward its locked position, to lock said lever in locked position, a cavity defined within said handle at the front region thereof, dimensioned to receive said tang therein, and means defined on said tang for cooperating with said locking point to secure said tang axially within said cavity, when said lever is in its locked position.

2. The knife of claim 1 wherein the engaging portions of said contact and cammed surfaces are concentric with an arc generated by the swinging movement of said lever.

3. A knife accommodating interchangeable blades comprising a blade having a tang extending from the base thereof, an elongate handle having a front region and an opposed back region, said handle including a tension fork having a base forming at least a portion of said front region, and outer and inner fork arms attached to said base and extending substantially axially therefrom, said outer arm forming at least a portion of said back region and said inner arm defining a contact surface, an elongate lever having opposed pivot and locking points, mounted at its pivot point in the back region of said handle, for swinging movement toward and away from locked position in which the lever is substantially axially aligned with said handle, said lever defining, adjacent its pivot end, a cammed surface dimensioned to contact, slideably and forceably, said contact surface as said lever is swung toward its locked position, thus to force said inner arm toward said outer arm and lock said lever in locked position, an elongate cavity confined wholly within the front region of said handle, said cavity having a first elongate edge defined by said tension fork base, and a second elongate edge defined by said lever arm, with the latter in locked position, and complementary protuberance and recess means formed on said lever, at its locking point, and on said tang, for securing said tang axially within said cavity.

4. The knife of claim 3 which further comprises second protuberance and recess means formed on said first elongate edge of said cavity and on said tang for securing said tang axially within said cavity.

* * * * *